United States Patent [19]

Watanabe

[11] Patent Number: 4,647,180

[45] Date of Patent: Mar. 3, 1987

[54] DEVELOPING DEVICE AND ELECTRONIC COPYING APPARATUS

[75] Inventor: Junji Watanabe, Yokohama, Japan

[73] Assignee: Kabushiki Kaisha Toshiba, Yokohama, Japan

[21] Appl. No.: 790,152

[22] Filed: Oct. 23, 1985

[30] Foreign Application Priority Data

| | | | |
|---|---|---|---|
| Oct. 25, 1984 | [JP] | Japan | 59-224706 |
| Nov. 28, 1984 | [JP] | Japan | 59-251134 |
| Dec. 4, 1984 | [JP] | Japan | 59-256143 |

[51] Int. Cl.[4] ..... G03G 15/08

[52] U.S. Cl. ..... 355/3 DD; 355/14 D; 430/120; 222/DIG. 1

[58] Field of Search ..... 355/3 DD, 14 D, 3 R; 118/653, 657; 430/120; 222/DIG. 1, 271

[56] References Cited

U.S. PATENT DOCUMENTS

| | | | |
|---|---|---|---|
| 4,054,230 | 10/1977 | Suzuki et al. | 222/DIG. 1 X |
| 4,080,054 | 3/1978 | Watanabe | 355/3 DD |
| 4,142,655 | 3/1979 | Fantuzzo | 222/DIG. 1 X |
| 4,173,405 | 11/1979 | Swapceinski et al. | 355/3 DD |
| 4,197,813 | 4/1980 | Yano et al. | 222/DIG. 1 X |
| 4,261,290 | 4/1981 | Yamashita et al. | 355/3 DD X |
| 4,353,637 | 10/1982 | Parker | 355/14 D X |
| 4,370,053 | 1/1983 | Hirayama et al. | 355/14 D |
| 4,417,802 | 11/1983 | Forbes, II | 355/14 D X |
| 4,478,512 | 10/1984 | Zoltner | 355/3 DD |

*Primary Examiner*—A. G. Prescott

*Attorney, Agent, or Firm*—Schwartz, Jeffery, Schwaab, Mack, Blumenthal & Evans

[57] ABSTRACT

A developing device is constructed so that a developing agent resupply section is located side by side with a developing chamber, and a feed member for feeding a developing agent into the developing chamber is disposed in the developing agent resupply section.

17 Claims, 26 Drawing Figures

DEVELOPING DEVICE AND ELECTRONIC COPYING APPARATUS

BACKGROUND OF THE INVENTION

The present invention relates to a developing device used, for example, in an electronic copying apparatus and adapted to supply a developing agent to an electrostatic latent image formed on a photosensitive body.

Developing devices of this type generally comprise a developing chamber storing a developing agent and a developing roller, and are designed so that the developing agent is supplied as the developing roller rotates. When the developing agent in the developing chamber is in short supply, the chamber is replenished by a developing agent resupply section so that the developing agent can satisfactorily be supplied at all times.

Conventionally, however, the developing agent resupply section has been disposed above the developing chamber, so that the housing of the developing device would inevitably be tall and bulky.

SUMMARY OF THE INVENTION

The present invention is contrived in consideration of these circumstances, and is intended to provide a developing device simple in construction and designed so as to permit a reduction in the height of the device.

In order to achieve the above object, the developing device according to the present invention is constructed so that a developing agent resupply section is located side by side with a developing chamber, and a feed member for feeding a developing agent into the developing chamber is disposed in the developing agent resupply section.

BRIEF DESCRIPTION OF THE DRAWINGS

FIGS. 1 to 13 show one embodiment of the present invention, in which:

FIG. 1 is a schematic view of an electronic copying apparatus;

FIG. 2 is a vertical sectional view of a developing device;

FIG. 3 is a perspective view of a magnet roller;

FIG. 4 is a perspective view of a mixer;

FIG. 5 is a perspective view showing the drive system of the developing device;

FIG. 6 is a perspective view showing the ratchet mechanism of the drive system;

FIG. 7 is a side sectional view of the ratchet mechanism;

FIG. 8 is a front view of the ratchet mechanism;

FIG. 9 is a perspective view illustrating the loading-/unloading direction of the developing device;

FIG. 10 is a perspective view showing a copying apparatus in which the developing device has been applied; and FIGS. 11 to 13 are sectional views illustrating the processes of the developing agent resupply operation.

FIGS. 14 to 22 show another embodiment of the invention, in which:

FIG. 14 is a vertical sectional view of a developing device;

FIG. 15 is a perspective view showing the drive system of the developing device;

FIG. 16 is a sectional view showing driving gears on the developing chamber side;

FIG. 17 is a sectional view showing driving gears on the developing agent resupply section side; and FIGS. 18 to 22 are sectional views illustrating the processes of the developing agent resupply operation.

FIGS. 23 and 24 show one modified example of the first embodiment, in which:

FIG. 23 is a vertical sectional view of the developing device; and

FIG. 24 is a sectional view illustrating the developing agent resupply operation.

FIGS. 25 and 26 show another modified example of the first embodiment, in which:

FIG. 25 is a perspective view illustrating the loading-/unloading direction of the developing device; and FIG. 26 is a perspective view showing a copying apparatus in which the developing device has been applied.

DETAILED DESCRIPTION OF THE PREFERRED EMBODIMENTS

One embodiment of a developing device according to the present invention and applied to an electronic copying apparatus will now be described in detail with reference to the accompanying drawings of FIGS. 1 to 13.

Figure 1:
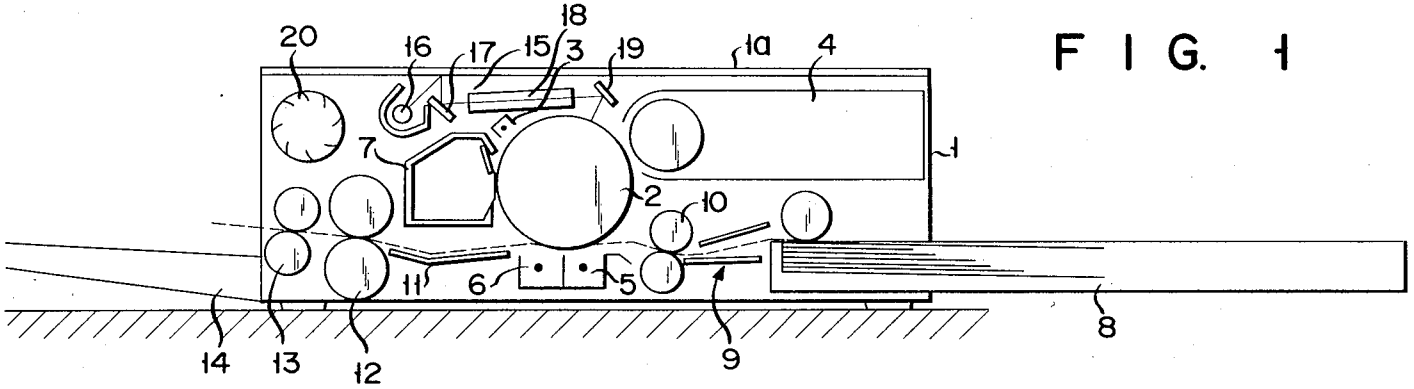

In FIG. 1, numeral 1 designates the housing of the electronic copying apparatus. A photosensitive drum 2, as an image carrier, is disposed in the central portion of the housing 1 so as to be rotatable in the clockwise direction of FIG. 1. The photosensitive drum 2 is surrounded by a main charger 3, a developing device 4, a transfer charger 5, a separation charger 6, and a cleaning unit 7, which are arranged successively in the rotating direction of the drum 2. A sheet cassette 8 is removably attached to the lower portion of the right-hand side of the housing 1. The sheet cassette 8 is designed so as to deliver paper sheets P one at a time. Each delivered sheet P is fed along a transport path 9 inside the housing 1. Aligning rollers 10, the transfer and separation chargers 5 and 6, a guide plate 11, a fixing unit 12, and exit rollers 13 are arranged successively in the feeding direction of the paper sheet P along the transport path 9. A receiving tray 14 is attached to the lower portion of the left-hand side of the housing 1.

An original table 1*a* is mounted for reciprocal movement on the top of the housing 1. An optical system 15 is provided under the original table 1*a*. The optical system 15 includes a lamp 16, a first mirror 17, a lens 18, and a second mirror 19. The image of an original put on the original table 1*a* is projected onto the photosensitive drum 2 by the optical system 15. A cooling fan 20 is disposed over the fixing unit 12 inside the housing 1, so that air in the housing 1 can be exhausted.

Figure 2:
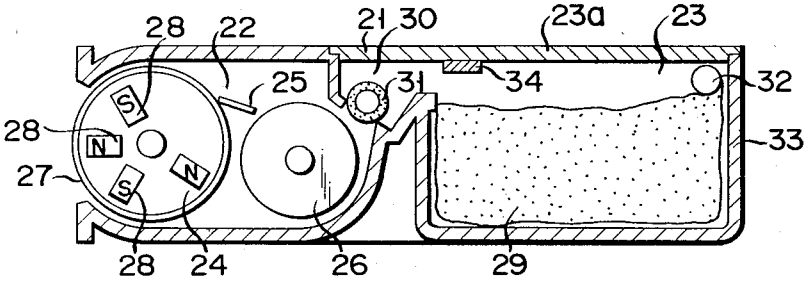
Figure 3:
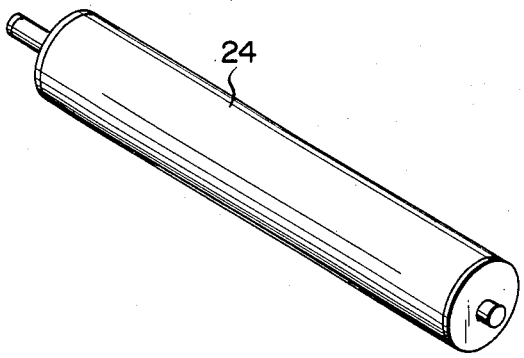
Figure 4:
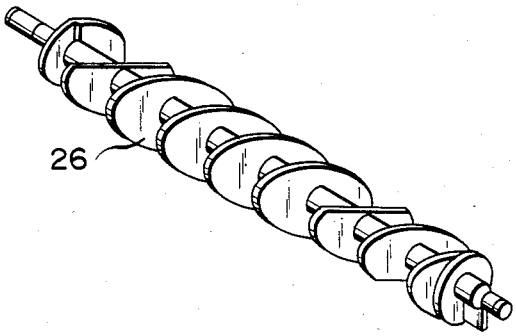

The developing device 4 is constructed as shown in FIG. 2. In FIG. 2, numeral 21 designates a flat developing vessel. A developing chamber 22 of substantially a rectangular shape, and a toner chamber 23, as a developing agent resupply section, are formed integrally with and adjacent to each other in the developing vessel 21. The developing chamber 22 contains a magnet roller 24 (see FIG. 3), a scraper 25, and a mixer 26 (see FIG. 4). The magnet roller 24, which consists of a sleeve 27 and permanent magnets 28 fixedly arranged therein, serves to carry a toner 29 from the developing chamber 22 to the photosensitive drum 2. The scraper 25 serves to scrape off the toner 29 which remains on the sleeve 27 without having been used in the developing process on the photosensitive drum 2. The removed toner 29 is stirred by the mixer 26 to prevent massing. An auxiliary chamber 30 is provided between the upper portions of the developing chamber 22 and the toner chamber 23 so as to connect the same. A resupply roller 31 is disposed in the auxiliary chamber 30 so that the toner 29 in the toner chamber 23 is fed into the developing chamber 22 at a fixed rate as the resupply roller 31 rotates.

Disposed in the toner chamber 23, moreover, is a film 33, as a feed mechanism, one end of which is fixed to the upper edge of the inner wall of the toner chamber 23 on the side of the auxiliary chamber 30, and the other end of which is wound around a shaft 32, as take-up means, provided opposite the auxiliary chamber 30 at the upper end of the inner wall of the toner chamber 23. The transverse length of the film 33 is equal to that of the developing vessel 21. The toner 29 is placed on the film 33. As the film 33 is taken up by the rotating shaft 32, therefore, the toner 29 on the film 33 is lifted up and transported into the auxiliary chamber 30.

The opening through which the toner 29 is resupplied is formed in that portion of the developing vessel 21 which corresponds to the top face of the toner chamber 23. A lid **23*a* is attached to the top portion of the developing vessel 21 so that the opening can be opened and closed as required. An ultrasonic sensor 34 is attached to the inside of the lid 23*a*. The ultrasonic sensor 34 detects the presence of the toner 29 in the toner chamber 23. The sensor 34 is adapted to rotate the shaft 32 when it is not in contact with the toner 29, and to deliver a signal for stopping the rotation of the shaft 32 when touched by the toner 29**.

Figure 5:
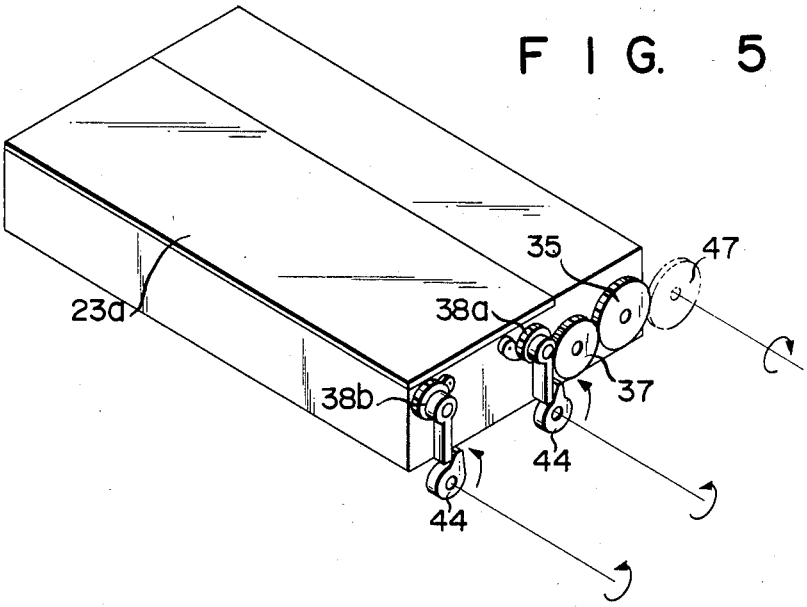

The drive system for the developing device 4 is constructed as shown in FIGS. 5 to 8. In FIG. 5, numeral 35 designates a gear attached to one side of the developing vessel 21 and adapted to rotate the magnet roller 26. The gear 35 is in mesh with a gear 37 for rotating the mixer 26. Also attached to the one side of the developing vessel 21 are first and second ratchet mechanisms **38*a* and 38*b* for rotating the resupply roller 31 and the shaft 32**, respectively.

Figure 6:
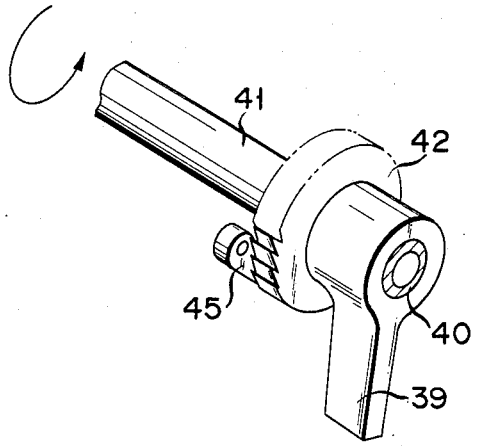
Figure 7:
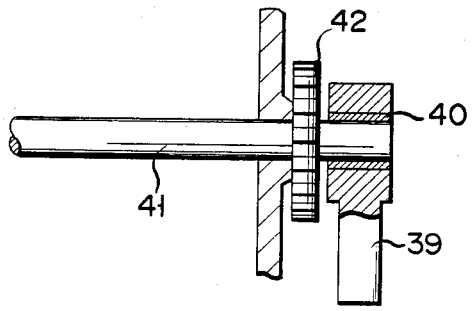
Figure 8:
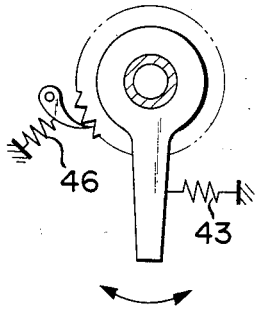

As shown in FIGS. 6 to 8, the first ratchet mechanism **38*a* is provided with a lever 39. The lever 39 is connected to the shaft 41 of the resupply roller 31 by means of a one-way clutch 40. A ratchet gear 42 is fixed to the shaft 41 so as to be locked in one direction by a ratchet 45. As shown in FIG. 8, the lever 39 is pulled by a spring 43, while the ratchet 45 is pressed by a spring 46. The second ratchet mechanism 38*b*, which is constructed in the same manner as the first ratchet mechanism 38*a*, is coupled to the shaft 32**.

As shown in FIG. 5, a gear 47 is in mesh with the gear 35, and a pair of cams 44 are connected individually to the respective levers 39 of the first and second ratchet mechanisms **38*a* and 38*b*. The gear 47 and the cams 44** are independently driven by a drive source on the housing side.

Figure 9:
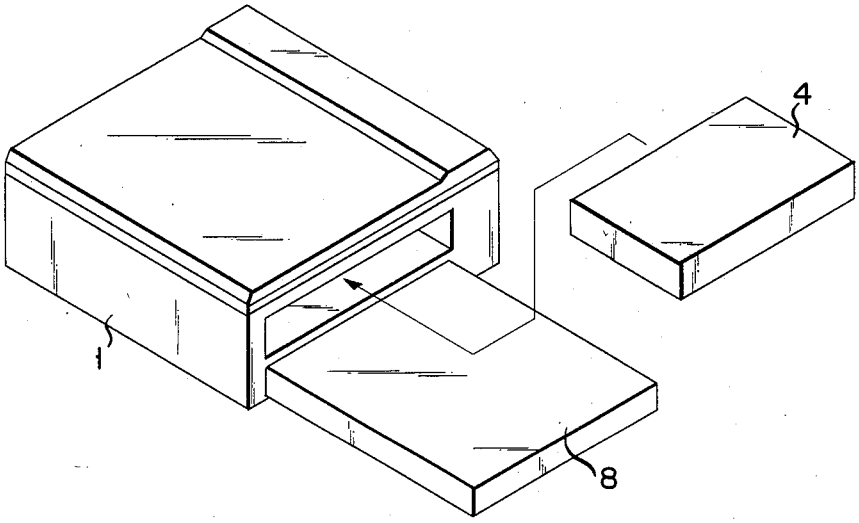
Figure 10:
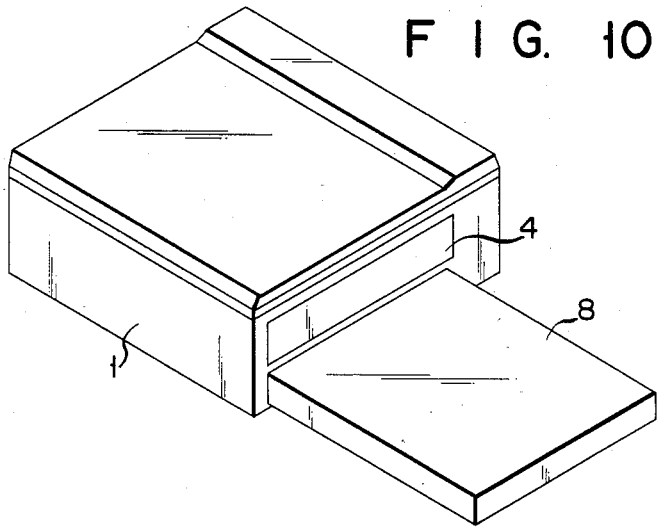

Meanwhile, the developing device 4 and the sheet cassette 8 are removably attached to the housing 1, and can be drawn out therefrom in the same direction, i.e., to the right of FIGS. 9 and 10.

The operation of the electronic copying apparatus with the above-mentioned construction will now be described.

In image forming, the original on the original table **1*a* is scanned with a light beam applied by the optical system 15, and a reflected light from the original is projected onto the photosensitive drum 2 through the first mirror 17, the lens 18, and the second mirror 19, forming an electrostatic latent image on the drum 2. The electrostatic latent image is supplied with the toner 29 from the developing device 4** and is thereby developed into a visible image.

In the developing process, the gear 47 rotates to cause the magnet roller 24 and the mixer 26 to rotate by means of the gears 35 and 37, so that the toner 29 is stirred and fed forward.

Figure 11:
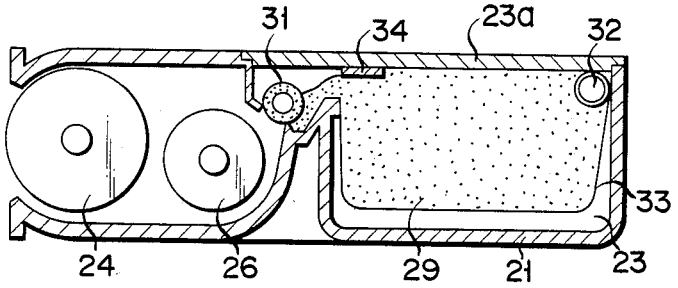
Figure 12:
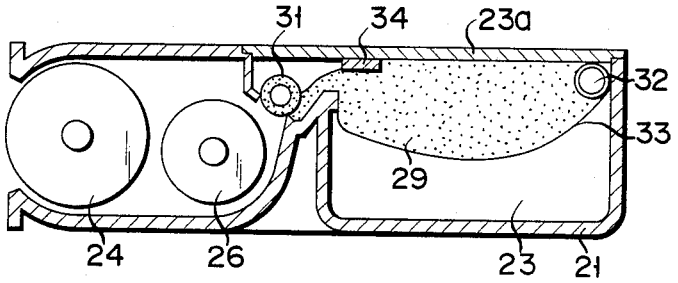
Figure 13:
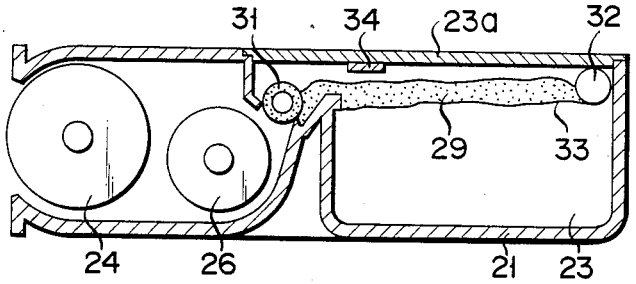
Figure 14:
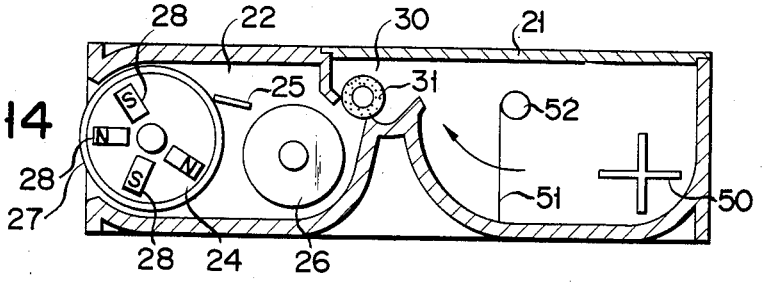

In the meantime, the resupply roller 31 in the auxiliary chamber 31 is rotated and the toner 29 in the auxiliary chamber 30 is fed into the developing chamber 22. When the ultrasonic sensor 34 loses contact with the toner 29 as the toner 29 is moved in this manner, the shaft 32 is rotated to take up the film 33. Thus, the toner 29 is lifted up and fed into the auxiliary chamber 30 as shown in FIGS. 11 to 13.

The developed image is transferred to the paper sheet P from the sheet cassette 8 by the transfer charger 6. Thereafter, the paper sheet P is separated from the photosensitive drum 2 by the separation charger 6 and fed along the guide plate 11 to the fixing unit 12. After the image is fixed by the fixing unit 12, the paper sheet P is discharged into the receiving tray 14 by the exit rollers 13.

At the time of maintenance or inspection of the developing device 4, or replenishment of the sheet cassette 8, the developing device 4 and the sheet cassette 8 are removed from the housing 1. Utilizing the same loading/unloading direction mentioned before, these two units can very easily be attached to or detached from the housing 1.

According to the embodiment described above, the toner chamber 23 is disposed side by side with the developing chamber 22, so that the developing device 4 is shorter in height than the prior art developing device in which the toner chamber is located above the developing chamber.

It is to be understood that the present invention is not limited to the above described embodiment, and that various changes and modifications may be effected therein by one skilled in the art without departing from the scope or spirit of the invention.

In the above embodiment, for example, the feed mechanism is described as including a windable film. In the alternative embodiment shown in FIGS. 14 to 22, however, the feed device may include a feed member 50 and a shoveling plate 51. In the description to follow, like reference numerals are used to designate like portions as included in the first embodiment, and a description of those portions is omitted.

The feed member 50 and the shoveling plate 51 are arranged in the toner chamber 23. The shoveling plate 51 is formed from a flexible material such as Mylar, rubber sheet, etc. The proximal end of the shoveling plate 51 is fixedly attached to a shaft 52 disposed in the toner chamber 23. The shoveling plate 51 is adapted to swing as the shaft 52 rotates. The distal end of the shoveling plate 51, which is normally in contact with the inner wall surface of the toner chamber 23, slides in an elastic manner along the same when the shoveling plate 51 swings.

Figure 15:
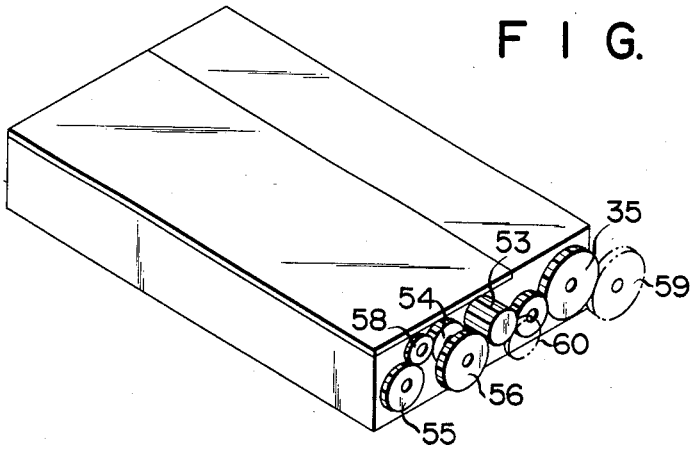
Figure 16:
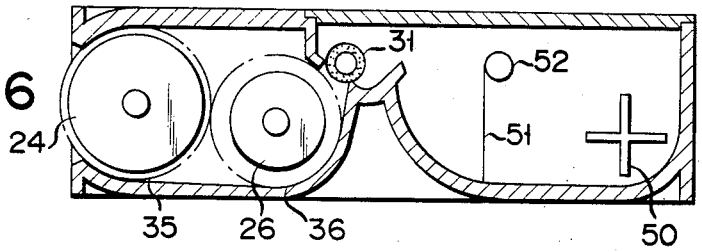
Figure 17:
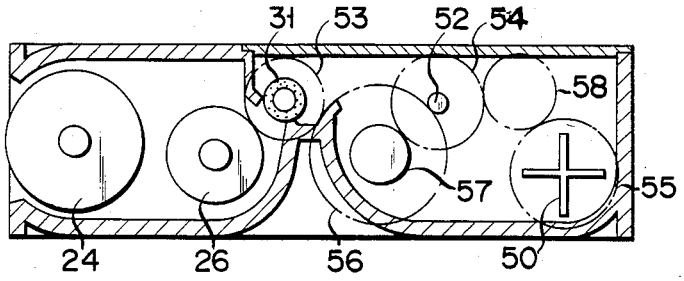
Figure 18:
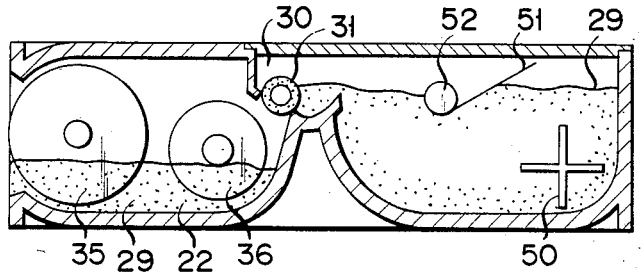
Figure 19:
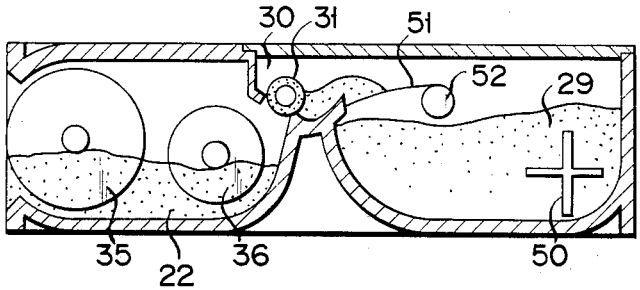
Figure 20:
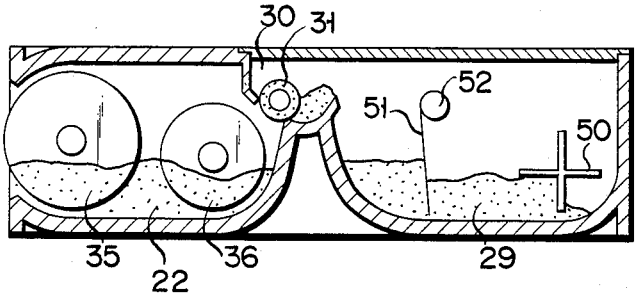
Figure 21:
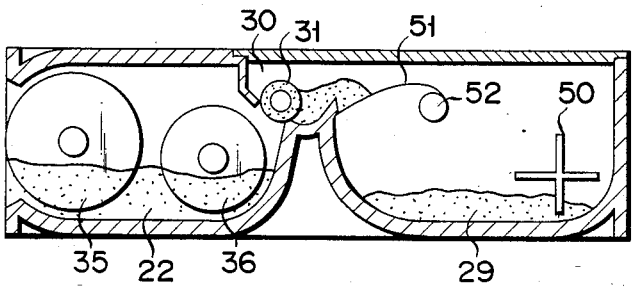
Figure 22:
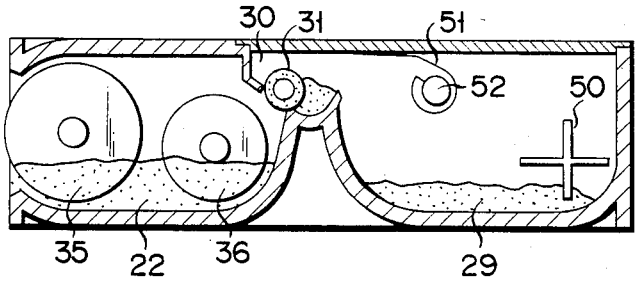

As shown in FIG. 15, the resupply roller 31, the shaft 52, and gears 53, 54 and 55, for rotating the feed member 50, are attached to one side of the developing vessel 21. The gears 53 and 54 are connected by means of the gear 56 and the gear 57 (see FIG. 17), coaxial therewith, while the gears 54 and 55 are connected by means of the gear 58. The gears 35 and 53 are engaged with gears 59 and 60, respectively, which are rotated by a drive source (not shown) disposed in the housing 1.

In the second embodiment described above, the gears 53, 56, 57, 54, 58 and 55 are rotated as the gear 60 on the housing side rotates at the time of developing. As the gear 54 rotates the shoveling plate 51 is swung, as shown in FIGS. 18 to 22, to feed the toner 29 into the auxiliary chamber 30. As the gear 53 rotates the resupply roller 31 is continuously rotated to move the toner 29 in the auxiliary chamber 30 into the developing chamber 22. Moreover, as the gear 55 rotates the feed member 50 is rotated to move the toner 29 from a region beyond the reach of the shoveling plate 51 to a region within the reach of the plate 51.

In the second embodiment, as in the first embodiment, the toner chamber 23 is disposed side by side with the developing chamber 22, so that the developing device 4 is shorter in height than the prior art developing device in which the toner chamber is located above the developing chamber.

Since the shoveling plate 51 is swingably disposed in the toner chamber 23 so that its distal end is in sliding contact with the inner wall surface of the toner chamber 23 for the express purpose of supplying toner, the toner 29 can be securely resupplied without the possibility of its remaining unused in the toner chamber 23.

Figure 23:
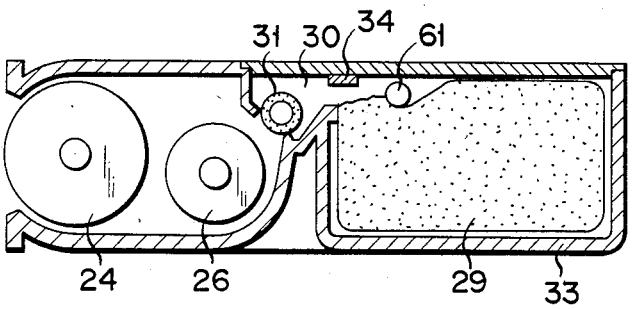
Figure 24:
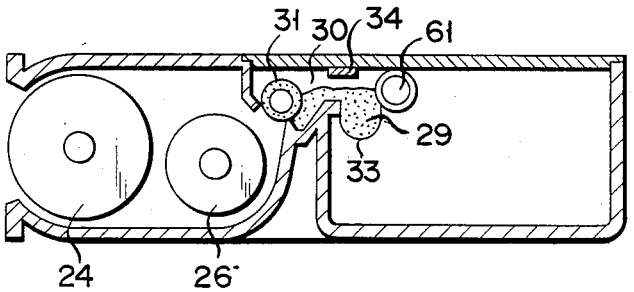

In the first embodiment, moreover, the shaft 32 is described as being disposed in that portion of the toner chamber 23 furthest removed from the auxiliary chamber 30. In the modified example shown in FIGS. 23 and 24, however, the shaft 61 for taking up the film 33 may be located close to the auxiliary chamber 30. According to this modification, an exhaustible supply of the toner 29 can be effected inside the film 33.

Figure 25:
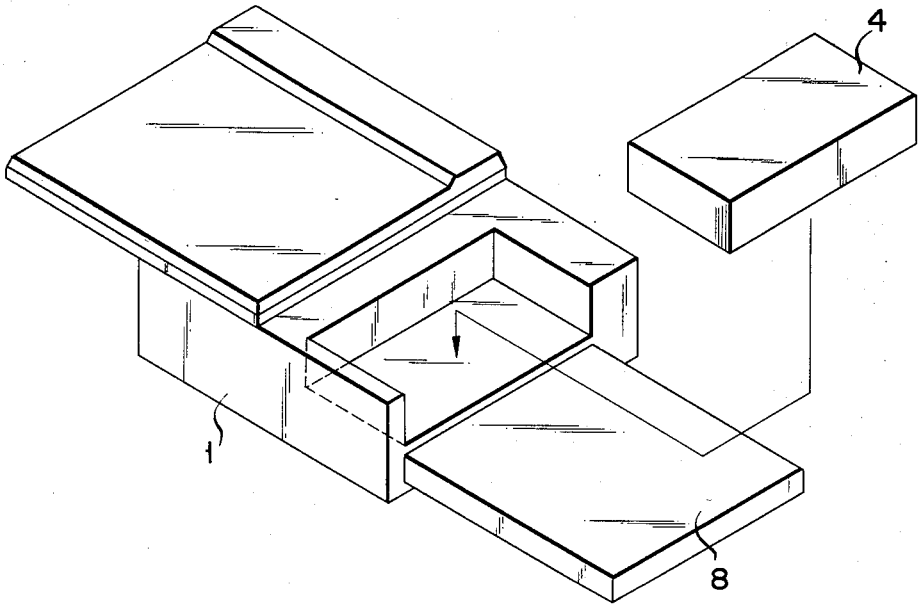
Figure 26:
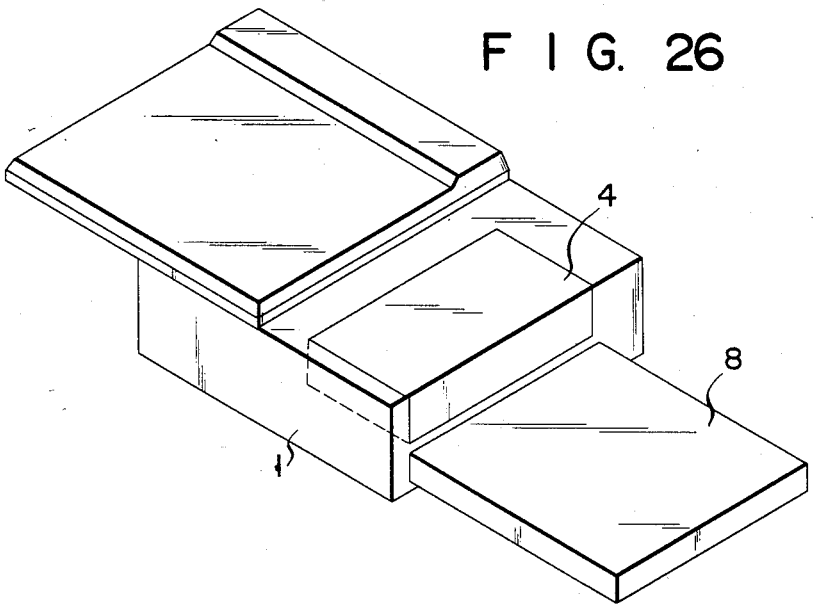

In the first embodiment, moreover, the developing device 4 is described as being loaded or unloaded in the same direction as the cassette 8. In the modified example shown in FIGS. 25 and 26, the developing device 4 may be loaded or unloaded through the top side of the housing 1 after removing the original table 1*a*.

What is claimed is:

1. A developing device whcih develops a latent image formed on the surface of an image carrier by means of a developing agent, comprising:

a flat developing vessel which has a flat upper wall and side walls dividing the developing vessel into a developing chamber located on the image carrier side, a developing agent resupply chamber disposed adjacent to the developing chamber on the side furthest removed from the image carrier, and an auxiliary chamber connecting the upper portions of the developing chamber and the developing agent resupply chamber;

supply means disposed in the developing chamber for supplying the developing agent in the developing chamber to the surface of the image carrier;

resupply means disposed in the auxiliary chamber for resupplying the developing agent from the auxiliary chamber to the developing chamber in response to the supply of the developing agent from the developing chamber by the supply means; and fee means disposed in the developing agent resupply chamber for delivering the developing agent in the developing agent resupply chamber to the resupply means.

2. A developing device which develops a latent image formed on the surface of an image carrier by means of a developing agent, comprising:

a flat developing vessel which has a flat upper wall and side walls dividing the developing vessel into a developing chamber located on the image carrier side, a developing agent resupply chamber disposed adjacent to the developing chamber on the side furthest removed from the image carrier, and an auxiliary chamber connecting the upper portions of the developing chamber and the developing agent resupply chamber;

supply means disposed in the developing chamber for supplying the developing agent in the developing chamber to the surface of the image carrier;

resupply means disposed in the auxiliary chamber for resupplying the developing agent to the developing chamber in response to a decrement of the developing agent in the developing chamber so as to compensate for the decrement; and feed means disposed in the developing agent resupply chamber and including a film disposed in the developing agent resupply chamber for carrying the developing agent thereon, one end of said film being fixed in the vicinity of the auxiliary chamber and the other end being windable; take-up means disposed in the developing agent resupply chamber and on which the non-fixed film end is mounted and drive means for driving the take-up means to take up the film, thereby feeding the developing agent from the developing agent resupply chamber into the auxiliary chamber.

3. The developing device according to claim 2, wherein said developing agent is formed of a magnetic toner, and said supply means includes a magnet roller.

4. The developing device according to claim 3, wherein said magnet roller includes a rotating sleeve and a plurality of magnets fixedly arranged in the sleeve.

5. The developing device according to claim 4, wherein said resupply means includes a resupply roller adapted to rotate so as to resupply the developing agent to compensate for said decrement of the developing agent caused by its delivery from the developing chamber by the supply means.

6. The developing device according to claim 5, wherein said feed means further includes detecting means for detecting the supply of the developing agent to the auxiliary chamber, and said drive means is driven to take up the film when a short supply of the developing agent is detected in the auxiliary chamber by the detecting means.

7. The developing device according to claim 6, wherein said take-up means is disposed in the upper portion of the developing agent resupply chamber on the side furthest from the auxiliary chamber.

8. The developing device according to claim 6, wherein said take-up means is disposed in the upper portIon of the developing agent resupply chamber on the side closest to the auxiliary chamber.

9. A developing device which develops a latent image formed on the surface of an image carrier by means of a developing agent, comprising:

a flat developing vessel which has a flat upper wall and side walls dividing the developing vessel into a developing chamber located on the image carrier side, a developing agent resupply chamber disposed adjacent to the developing chamber on the side furthest removed from the image carrier, and an auxiliary chamber connecting the upper portions of the developing chamber and the developing agent resupply chamber;

supply means disposed in the developing chamber and adapted to supply the developing agent in the developing chamber to the surface of the image carrier;

resupply means disposed in the auxiliary chamber and adapted to resupply the developing agent to the developing chamber in response to a decrement of the developing agent in the developing chamber so as to compensate the decrement; and feed means disposed in the developing agent resupply chamber and including a rotating shaft rotatably disposed in the developing agent resupply chamber, a shoveling plate capable of elastic deformation and having a proximal end mounted on the rotating shaft and a distal end capable of being in sliding contact with the inner surface of the developing agent resupply chamber, and drive means for driving the rotating shaft to rotate the shoveling plate, thereby feeding the developing agent from the developing agent resupply chamber into the auxiliary chamber.

10. The developing device according to claim 9, wherein said drive means continuously rotates the rotating shaft.

11. The developing device according to claim 9, wherein said developing agent is formed of a magnetic toner, and said supply means includes a magnet roller.

12. The developing device according to claim 11, wherein said magnet roller includes a rotating sleeve and a plurality of magnets fixedly arranged in the sleeve.

13. The developing device according to claim 12, wherein said resupply means includes a resupply roller adapted to rotate so as to resupply the developing agent to compensate for the decrement of the developing agent caused by its delivery from the developing chamber by the supply means.

14. The developing device according to claim 13, wherein said feed means further includes detecting means for detecting the supply of the developing agent to the auxiliary chamber, and said drive means is driven to rotate the shoveling plate when a short supply of the developing agent is detected in the auxiliary chamber by the detecting means.

15. An electronic copying apparatus comprising:

a housing;

an image carrier disposed in the housing and carrying thereon a latent image corresponding to an original image;

developing means for developing the latent image on the surface of the image carrier by means of a developing agent, said developing means including a flat developing vessel attached to the housing so as to be removable therefrom in a first direction; and a cassette attached to the housing so as to be removable therefrom in a second direction, deliverably storing, prior to delivery, paper sheets to which a developing agent image developed by the developing means is to be transferred.

16. The electronic copying apparatus according to claim 15, wherein said developing vessel and said cassette are attached to one side of the housing.

17. The electronic copying apparatus according to claim 16, wherein said first and second directions are identical.

* * * * *